United States Patent [19]

Lauke et al.

[11] Patent Number: 4,782,000

[45] Date of Patent: Nov. 1, 1988

[54] ELECTROPHOTOGRAPHIC RECORDING ELEMENTS WITH HYDROLYZED SILANE LAYER

[75] Inventors: Harald Lauke, Mannheim; Reinhold J. Leyrer; Bernhard Nick, both of Ludwigshafen; Thomas Loerzer, Frankenthal, all of Fed. Rep. of Germany

[73] Assignee: BASF Aktiengesellschaft, Ludwigshafen, Fed. Rep. of Germany

[21] Appl. No.: 64,538

[22] Filed: Jun. 22, 1987

[30] Foreign Application Priority Data

Aug. 16, 1986 [DE] Fed. Rep. of Germany ..... 3627758

[51] Int. Cl.[4] ..... G03G 5/14; G03G 13/28

[52] U.S. Cl. ..... 430/60; 430/64; 430/49; 430/131

[58] Field of Search ..... 430/49, 60, 64, 131

[56] References Cited

U.S. PATENT DOCUMENTS

| | | | |
|---|---|---|---|
| 3,276,868 | 10/1966 | Uhlig | 430/49 |
| 3,440,050 | 4/1969 | Chu | 101/463 |
| 3,902,976 | 9/1975 | Walls | 204/28 |
| 3,907,562 | 9/1975 | Crystal | 430/49 |
| 4,063,948 | 12/1977 | Lind | 430/83 |
| 4,066,453 | 1/1978 | Lind et al. | 430/49 |
| 4,153,461 | 5/1979 | Berghauser et al. | 427/327 |
| 4,405,702 | 9/1983 | Shirai et al. | 430/60 |
| 4,439,509 | 3/1984 | Sclank | 430/67 X |
| 4,464,450 | 8/1984 | Teuscler | 430/60 X |
| 4,571,371 | 2/1986 | Yashiki | 430/60 X |

FOREIGN PATENT DOCUMENTS

| | | | |
|---|---|---|---|
| 51-36138 | 3/1976 | Japan | 430/60 |
| 1419643 | 12/1975 | United Kingdom . | |
| 1444381 | 7/1976 | United Kingdom . | |

OTHER PUBLICATIONS

Lieng-Huang Lee, "Adhesive Chemistry", vol. 29, pp. 139–163.

*Primary Examiner*—Roland E. Martin
*Attorney, Agent, or Firm*—Keil & Weinkauf

[57] ABSTRACT

An electrophotographic recording element consisting of an aluminum base, which is mechanically, chemically and/or electrochemically pretreated in a conventional manner, and a photoconductive layer which is applied to this base is produced by a process in which a thin layer which imparts hydrophilic properties and consists of a hydrolysis product or condensate of a silane is applied between the base and the photoconductive layer.

These recording elements are particularly useful for electrophotographic offset printing.

1 Claim, No Drawings

ELECTROPHOTOGRAPHIC RECORDING ELEMENTS WITH HYDROLYZED SILANE LAYER

The present invention relates to a process for the production of electrophotographic recording elements from a pretreated aluminum base and a photoconductive layer, wherein an intermediate layer is applied between the base and the photoconductive layer, and the use of these electrophotographic recording elements for electrophotographic offset printing, in particular recording elements of this type which can be developed with aqueous, alcoholic or aqueous/alkaline solutions.

The use of homogeneously sensitized photoconductor layers for the production of electrophotographic printing plates, in particular electrophotographic offset printing plates, is known. Such layers and the associated processes are described in, for example, German Pat. No. 1,117,391 and German Laid-Open Applications DOS No. 2,322,047 and DOS No. 2,526,720. Such electrophotographic offset printing plates essentially consist of (A) an electrically conductive aluminum base which is suitable for offset printing, is from 0.1 to 0.6 mm thick and has, for example, an electrolytically roughened or anodized surface, and (B) an electrophotographic layer comprising (B1) one or more binders which are compatible with all components present in the formulation and are soluble in washout media typically used for offset plates, (B2) a low molecular weight charge-transporting compound, (B3) one or more sensitizers for the desired actinic range and (B4) other additives which improve the general properties of the layer.

In a conventional embodiment of these photoconductor layers and printing plates, the photoconductor layer applied to the electrically conductive base is charged and exposed imagewise, the image is developed with a liquid or dried toner, the toner image is fixed by heating, and the printing plate is developed by dissolving away the untoned photoconductor layer. The resulting offset printing plate accepts printing ink in the toner image regions and accepts water in the bared areas of the base surface.

A base intended to be used for photosensitive material for the production of a printing plate must essentially satisfy two criteria. On the one hand, the printing image areas developed from the resist layer of the material must adhere very firmly to the said base and, on the other hand, the base must constitute a sufficiently hydrophilic image background, so that it retains its repellency toward oleophilic printing inks under the varied conditions of the printing process. The latter is achieved by means of a porous surface structure, so that the surface of the base retains sufficient water to repel oleophilic printing inks to an adequate extent.

Principally aluminum and aluminum alloys are used for offset printing plates, these alloys being modified by a number of pretreatment steps in order to ensure good adhesion of the radiation-sensitive layer and hence long print runs.

For example, aluminum is mechanically, chemically and/or electrochemically roughened, if necessary pickled, and then anodically oxidized. The standard pretreatment methods include electrochemical roughening in HCl and/or $HNO_3$ and anodic oxidation in $H_2SO_4$ and/or $H_3PO_4$.

In the prior art, such anodized bases are usually subjected to a further treatment step to improve the layer adhesion, to increase the hydrophilicity or to facilitate development of the photosensitive resist films. The patent literature describes, inter alia, methods such as silicatization (cf. for example German Laid-Open Application DOS No. 2,532,769 and U.S. Pat. No. 3,902,976) or treatment with complex fluorides (cf. for example German Published Application DAS No. 1,300,415 and U.S. Pat. No. 3,440,050) or with polyvinylphosphonic acid (cf. for example German Pat. Nos. 1,134,093 and 1,621,478 and U.S. Pat. Nos. 3,276,868 and 4,153,461.

However, the methods described above have more or less serious disadvantages. For example, in the treatment with alkali metal silicates, it is necessary to accept a certain deterioration in the shelf life.

Although the use of polyvinylphosphonic acid (PVPA) for aftertreating the base leads to good printing properties in the printing plates, the deposition of PVPA on the base can give rise to problems during production, such as the formation of an extremely poorly soluble precipitate as a result of the reaction with $Al^{3+}$ions, which results in wetting problems or fragmentation of the layer during development or printing.

Moreover, when stored in the uncoated state, PVPA-treated bases tend to exhibit ageing phenomena. These manifest themselves in decreasing hydrophilicity and in the reduced developability of negative-working photosensitive layers which are applied long after production of the base.

It is an object of the present invention to provide a class of compounds which, as an intermediate layer between the base and the photoconductive layer, increases the hydrophilicity of the nonimage areas without adversely affecting the adhesion of the radiation-sensitive layer to the base, and thus avoids the above disadvantages of known treatment agents.

It is known that silanes can be used as adhesion-promoting or coupling compounds, in particular when it is intended to ensure that a plastic adheres to glass surfaces or glass fibers (cf. for example Lieng-Huang Lee, Adhesive Chemistry, vol. 29, page 139 et seq). However, silanes are used as adhesion promoters in dry offset printing plates too. The principle of the dry lithographic printing plate is to ensure differentiation between printing and non-printing parts by means of an ink-accepting, photosensitive polymer layer and an oleophobic silicone rubber layer which repels oily ink and is thus non-printing. For this purpose, for example, a photosensitive polymer layer is applied to a silicone rubber layer present on a metal base, and is exposed imagewise and developed, so that, for example in the case of a negative-working plate, the silicone rubber layer is bared in the unexposed areas while the polymer layer cured by actinic radiation and insoluble in the developer is formed in the exposed parts. Since, because of its special properties, a silicone rubber with high ink repellency does not have good adhesion to other materials, a silane coupling agent is used, this agent acting as a contact adhesive between the base and the silicone rubber (cf. for example German Pat. No. 2,357,871 and 2,323,453).

It was therefore surprising that the novel aftertreatment of aluminum bases, pretreated according to the prior art, with an aqueous or alcoholic sclution of a silane hydrolysis product or condensate, formed by hydrolysis of silanes, improved the hydrophilic properties of the base to such an extent that the non-image areas of the imagewise exposed plate showed no ink acceptance after development in an aqueous alkaline medium and application of an oily ink, since, according to the prior art, it was not to be expected that silane hydrolysis products can be used for improving hydrophilicity. In a photosensitive lithographic printing plate which can be developed in an aqueous alkaline medium, the base which had not been aftertreated accepted ink in the non-image areas too.

We have found that this object is achieved by a process for the production of an electrophotographic recording element from an aluminum base which is mechanically, chemically and/or electrochemically pretreated and anodically oxidized in a conventional manner and a photoconductive layer which is applied on this base, wherein a thin layer which imparts hydrophilic properties and consists of a hydrolysis product or condensate of one or more silanes is applied between the base and the photoconductive layer.

Silanes which are particularly useful in hydrolyzed or condensed form for the novel process are those of the general formula (I)

$$X\text{-}(CH_2)_y\text{-}Si(R^1)_n(OR^2)_{3-n} \quad (I)$$

where $R^1$ and $R^2$ are identical or different and are each alkyl of 1 to 9 carbon atoms or aryl of 6 to 12 carbon atoms, X is one of the radicals

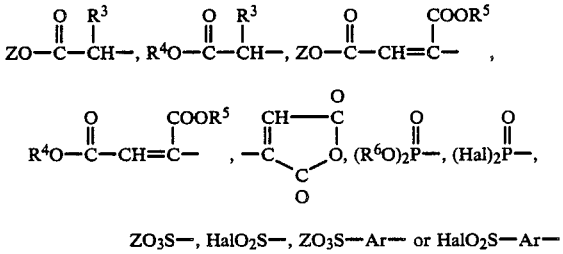

$ZO_3S-$, $HalO_2S-$, $ZO_3S-Ar-$ or $HalO_2S-Ar-$ $R^3$ is hydrogen, alkyl of 1 to 9 carbon atoms, a carboxylic acid of 1 to 9 carbon atoms or a carboxylic anhydride ring formed from this carboxylic acid radical and the

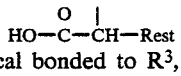

radical bonded to $R^3$, and $R^4$ and $R^5$ are identical or different and are each alkyl of 1 to 9 carbon atoms or aryl of 6 to 12 carbon atoms, $R^6$ is hydrogen, alkyl of 1 to 9 carbon atoms or aryl of 6 to 12 carbon atoms, Ar is arylene of 6 to 12 carbon atoms, Z is hydrogen or an alkali metal, Hal is chlorine or bromine, y is an integer from 1 to 4 and n is 0, 1 or 2.

The silanes of the above formulae are used in hydrolyzed or condensed form.

In the novel process, the hydrolysis product or condensate of the silane is applied to the pretreated aluminum base in general in the form of a solution by a conventional application method, such as spraying or immersion, any excess is removed and the coated base is dried at from 50° to 120° C.

The present invention furthermore relates to electrophotographic recording elements produced by the novel process and to their use for the electrophotographic production of offset printing plates.

The hydrolysis product or condensate of the silane is advantageously used in aqueous or alcoholic solution.

These solutions contain the hydrolysis product or condensate of the silane in general in amounts of from 0.05 to 30, preferably from 0.1 to 10, in particular from 0.5 to 3, % by weight. They can be prepared from the parent silanes of the general formula (I) in a conventional manner by hydrolysis, with or without acid catalysis. Applications of these solutions to the mechanically, chemically and/or electrochemically pretreated aluminum base in a thin layer can be effected by a conventional application method, preferably by spraying or, in particular, by immersing the base in the aqueous solution, at from 15° to 85° C., preferably from 25° to 60° C., for example for from 0.5 to 120, preferably from 10 to 60, seconds.

Excess solution can then be removed by washing or spraying with water or alcohol, and the bases aftertreated in this manner can be dried at from 20° to 120° C., preferably from 50° to 110° C.

As stated above, particularly suitable silanes for the novel process are those of the general formula (I)

$$X\text{-}(CH_2)_y\text{-}Si(R^1)_n(OR^2)_{3-n} \quad (I)$$

where $R^1$ and $R^2$ are identical or different and are each alkyl of 1 to 9, preferably 1 to 4, carbon atoms, eg. methyl, ethyl, propyl, isopropyl, butyl or isobutyl, or aryl of 6 to 12 carbon atoms, such as phenyl, benzyl or methylphenyl, X is one of the radicals

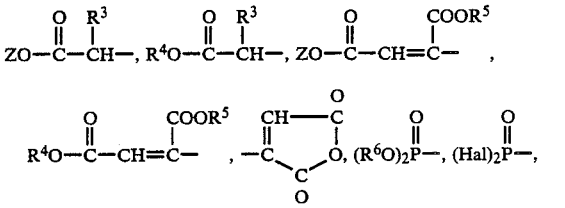

$ZO_3S-$, $HalO_2S-$, $ZO_3S-Ar-$ or $HalO_2S-Ar-$ and $R^3$ is hydrogen, alkyl of 1 to 9, preferably 1 to 4, carbon atoms, eg. methyl, ethyl, propyl or butyl, a carboxylic acid radical of 1 to 9, preferably 1 to 4, carbon atoms, eg. -COOH, $-CH_2COOH$, $-C_2H_4COOH$ or $-C_3H_6COOH$, or a carboxylic anhydride ring formed from this carboxylic acid radical and the

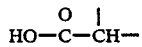

radical bonded to $R^3$, eg. a succinic anhydride ring, $R^4$ and $R^5$ are identical or different and are each alkyl of 1 to 9, preferably 1 to 4, carbon atoms, eg. methyl, ethyl, propyl or butyl, or aryl of 6 to 12 carbon atoms, eg. phenyl, benzyl or methylphenyl, $R^6$ is hydrogen, alkyl of 1 to 9, preferably 1 to 4, carbon atoms, eg. methyl, ethyl, propyl or butyl, or aryl of 6 to 12 carbon atoms, eg. phenyl, benzyl or methylphenyl, Ar is arylene of 6 to 12 carbon atoms, preferably phenylene, Z is hydrogen or an alkali metal, such as Li, Na or K, or $NH_4$, Hal is chlorine or bromine, preferably chlorine, y is an integer from 1 to 4, in particular 3, and n is 0, 1 or 2.

Examples of preferred silanes are (2-tripropoxysilylethyl)-carboxylic acid, (3-trimethoxysilylpropyl)-carboxylic acid, (4-trimethoxysilylbutyl)-carboxylic acid and their methyl, ethyl, propyl and butyl esters, (3-triethoxysilylpropyl)-succinic anhydride, (3-triethoxysilylpropyl)-maleic, anhydride, dimethyl (2-trimethoxysilylethyl)-phosphonate, dimethyl (3-triethoxysilylpropyl)-phosphonate, diethyl (3-triethoxysilylpropyl)-phosphonate, (2-trimethoxysilylmethyl)-phosphonic acid dichloride, (3-trimethoxysilylpropyl)-phosphonic acid dichloride, (3-trimethoxysilylpropyl)-phosphonic acid, 2-(4-chlorosulfonylphenyl)-ethyltrimethoxysilane, 2-(4-sulfonylphenyl)-ethyltrimethoxysilane, (3-trimethoxysilylpropyl)-sulfonyl chloride and (3-trimethoxysilylpropyl)-sulfonic acid.

Silanes of this type can be hydrolyzed in a conventional manner in water or aqueous solutions of alcohols, in the presence or absence of an acid. A certain degree of condensation may take place during the hydrolysis. Hydrolysis products and condensates of the above silanes, as well as mixtures of these hydrolysis products and condensates, are suitable for the novel process provided that it is ensured that the hydrolysis products or condensates are completely dissolved in the aqueous or alcoholic solution.

The aluminum bases used for the novel process are mechanically, chemically and/or electrochemically pretreated and anodically oxidized in a conventional manner. Pretreatment methods of this type are described in, for example, Wernick, Pinner, Zurbrügg and Weiner, Die Oberflächenbehandlung von Aluminium, Eugen G. Leuze Verlag, 1977.

After the novel treatment of the pretreated aluminum base with the solution of the hydrolysis product or condensate of the silane and drying of the thin layer, the aftertreated aluminum base is provided with the photoconductive layer in a conventional manner. This photoconductive layer may consist of a single-layer or two-layer system.

Suitable single-layer systems preferably possess, on a conductive base (A) treated according to the invention with a silane hydrolysis product, a layer (B) of (a) from 65 to 35% by weight of one or more organic binders, (b) from 30 to 60, in particular from 38 to 46, % by weight of a mixture of the charge carrier-transporting compounds and (c) from 0.02 to 2.5% by weight of a compound which produces charge carriers when exposed to actinic light, in particular a suitable dye. Advantageously, the layers are applied from a solution of about 6% strength by weight in a suitable organic solvent onto the base treated according to the invention, in such a way that, after the solvent has been evaporated in the air, the resulting dry layer is about 0.8–40 μm thick, depending on the intended use; in electrophotographic printing plates, this layer is, in particular, from 0.8 to 6 μm thick.

Suitable multilayer systems possess, on the conductive base (A) treated according to the invention with a silane hydrolysis product, for example (α) a charge carrier-producing layer and (β) a charge-transporting layer consisting of from 30 to 60% by weight of a mixture of charge carrier-transporting compounds, from 65 to 35% by weight of an organic binder and, if required, up to 15% by weight of other additives which improve the mechanical properties of the layer. The first layer is advantageously applied to the base in a thickness of from 0.005 to 5 μm, in particular from 0.1 to 0.9 μm, as a solution in a suitable solvent. After the application, the second layer is applied in a thickness such that, after drying of the composite structure, the resulting layer is from 5 to 25, in particular from 7 to 15, μm thick.

The type of organic binder (a) suitable for the layers depends on the intended use of the recording materials. For the copying sector, for example, cellulose ethers, polyester resins, polyvinyl chlorides, polycarbonates, copolymers, such as styrene/maleic anhydride copolymers or vinyl chloride/maleic anhydride copolymers, or mixtures of such binders are suitable. The choice of binders is based in particular on their film-forming and electrical properties, their adhesion to the base and their solubility properties. Particularly in the case of recording materials for the production of electrophotographic printing plates, and especially those for offset printing, particularly suitable binders are those which are soluble in basic, aqueous or alcoholic solvents. These are, in particular, substances possessing groups, such as anhydride, carboxyl, sulfo, phenol or sulfonimide groups, which impart solubility in alkalis. Preferred binders are those which are readily soluble in basic aqueous alcoholic solvent systems and have a mean molecular weight (weight average) of from 800 to 80,000, in particular from 1,500 to 50,000, particularly preferred binders of this type having a high acid number. Examples of suitable binders are copolymers of methacrylic acid and methacrylates, in particular copolymers of styrene and maleic anhydride and of styrene, methacrylic acid and methacrylates, provided that they satisfy the above solubility conditions. For example, we have found that copolymers of styrene, maleic anhydride and acrylic or methacrylic acid which contain from 5 to 50% by weight of copolymerized maleic anhydride and from 5 to 35, in particular from 10 to 30, % by weight of copolymerized acrylic or methacrylic acid give satisfactory electrophotographic layers having a sufficiently low conductivity in the dark. They have excellent solubility in developers consisting of 75% by weight of water, 23% by weight of isobutanol and 2% by weight of sodium carbonate, but are insoluble in fountain solution typically used for offset printing plates.

Suitable charge carrier-transporting compounds (b) which are present in this layer are compounds of this type which do not adversely affect transparency to visible light, such as low molecular weight compounds, in particular heterocyclic compounds, eg. pyrazoline derivatives, oxazoles, oxadiazoles, phenylhydrazones, imidazoles, triphenylamine derivatives, carbazole derivatives, pyrene derivatives and other, fused aromatics and compounds stated for this purpose in European Patent Application 86105253.8, as well as polymeric materials, such as polyvinylpyrenes, poly-(N-vinylcarbazole), copolymers of carbazole and styrene or vinyl acetate and/or vinyl chloride. Among the polymers, poly-(N-vinylcarbazole) is particularly suitable.

Examples, for single-layer systems, of suitable compounds (c) which produce charge carriers when exposed to actinic light, or sensitizers, as used for the production of electrophotographic printing plates, are dyes from the triarylmethane series, xanthene dyes and cyanine dyes. Very good results were obtained, for example, using Rhodamine B (C.I. 45170), Rhodamine 6 G (C.I. 45160), malachite green (C.I. Basic Green 4; C.I. 4,200), methyl violet (C.I. 42535) or crystal violet (C.I. 42555). In multilayer systems, the dye or the pigment is present in a separate charge carrier-producing layer.

Azo dyes, phthalocyanines, isoindoline dyes and perylenetetracarboxylic acid derivatives are effective in this case. Particularly good results are obtained using perylene3,4:9,10-tetracarboxylic acid diimide derivatives, as described in German Laid-Open Applications DOS No. 3,110,954 and DOS No. 3,110,960.

For the particular use, the electrophotographic recording material may contain conventional additives, for example leveling agents and plasticizers in the photoconductive layer or adhesion promoters between the base and the layer.

Electrophotographic offset printing plates are produced in a conventional manner by electrostatic charging of the electrophotographic recording material by means of a high voltage corona followed directly by imagewise exposure, development of the resulting electrostatic, latent charge image by means of a dry or liquid toner, fixing of the toner by a downstream melting process and removal of the untoned, photoconductive layer by means of a suitable washout solvent. The printing plate thus obtained can futhermore be prepared in a conventional manner for offset printing, for example by gumming the waterconveying surface.

In the Examples and Comparative Examples, parts and percentages are by weight, unless stated otherwise.

Test of suitability for offset printing

The plates produced in each case were tested by wiping the ready-prepared printing plate with a fatty printing ink conventionally used in the printing industry, the ratings in the inking test having the following meanings: A: could be washed completely clean, no ink acceptance in the nonimage areas, suitable for difficult applications in offset printing; B: slightly shaded or mottled, slight ink acceptance (still suitable for offset printing); C: pronounced shading, unsuitable for offset printing.

The ratings relate in each case to the nonprinting areas of the printing plate.

COMPARATIVE EXAMPLE 1

An aluminum sheet electrochemically roughened by treatment with alternating current in aqueous HCl and $HNO_3$ solution and anodically oxidized in sulfuric acid is coated with a 10% strength solution of an electrophotographic recording material in tetrahydrofuran so that the layer weight after drying (for 30 minutes at 80° C.) is 4 g/m$^2$.

The electrophotographic recording material used for this purpose has the following composition:

54.6% of a copolymer of styrene and methacrylic acid (weight ratio 2:1),

45% of 2,5-bis-(4'-diethylaminophenyl)-1,3,4-oxadiazole and 0.4% of C.I. Basic Red 1; C.I. no. 45160.

The layer is then charged to a surface potential of −850 V using a corona 10 mm away and a high voltage source of 6.75 kV connected to the corona, and is exposed through a test transparency for 15 seconds in a process camera having 4 halogen lamps of 1000 W each.

When the latent charge image formed by exposure is treated with a commercial toner, an image of the original is obtained, and is fixed by heating.

For conversion to a printing plate, the aluminum foil with the toned photoconductive layer is introduced into a cell and developed with the aid of a commercial aqueous alkaline developer.

The printing plate thus produced is inked with printing ink. Test result: Rating: C

COMPARATIVE EXAMPLE 2

An aluminum sheet electrochemically roughened by treatment with alternating current in aqueous HCl and $HNO_3$ solution and anodically oxidized in phosphoric acid serves as the base for a printing plate produced as described in Comparative Example 1. Test result: Rating: C

EXAMPLE 1

A 3% strength aqueous solution of the corresponding silane hydrolysis product is prepared by hydrolysis of (3-triethoxysilylpropyl)-succinic anhydride in water.

An aluminum sheet electrochemically pretreated as described in Comparative Example 1 and anodically oxidized in sulfuric acid is immersed in this solution at 60° C. for 60 seconds, washed thoroughly with water and then dried at 80° C.

The plate aftertreated in this manner is then coated, exposed imagewise, developed and inked, these steps being carried out as described in Comparative Example 1.

Test result:
Rating: B

EXAMPLE 2

A printing plate coated and aftertreated as described in Example 1 is stored for 30 days at 50° C. and then processed in a conventional manner.

Result:
Rating: B

EXAMPLE 3

The procedure described in Example 1 is followed, except that the aluminum sheet is anodically oxidized in phosphoric acid, as described in Comparative Example 2.

Result:
Rating: B

EXAMPLE 4

A printing plate coated and aftertreated as described in Example 1 is stored for 30 days at 50° C. and then processed in a conventional manner.

Test result:
Rating: B

EXAMPLE 5

An aluminum sheet as described in Comparative Example 1, anodically oxidized in sulfuric acid, is processed as described in Example 1, except that the temperature of the 3% strength solution of the silane hydrolysis product is 25° C.

Test result:
Rating: A

EXAMPLE 6

A printing plate produced as described in Example 5 is first stored for 30 days at 50° C. and then processed in a conventional manner.

Test result:
Rating: A

EXAMPLE 7

An aluminum sheet as described in Comparative Example 2, anodically oxidized in phosphoric acid, is processed as described in Example 1, except that the temperature of the 3% strength solution of the silane hydrolysis product is 25° C.
Test result:
Rating: A

EXAMPLE 8

A printing plate produced as described in Example 7 is first stored for 30 days at 50° C. and then processed in a conventional manner.
Test result:
Rating: A

EXAMPLE 9

An aluminum sheet as described in Comparative Example 1, anodically oxidized in sulfuric acid, is processed as described in Example 1, except that the after-treatment is carried out by immersion in a 1% strength solution of the silane hydrolysis product at 25° C.
Test result:
Rating: A The printing plate produced in this manner gave 100,000 satisfactory prints on a newspaper rotary printing press (COLORMAN), despite several interruptions and running-dry of the printing plate.

EXAMPLE 10

A printing plate produced as described in Example 9 is first stored for 30 days at 50° C. and then processed in a conventional manner.
Test result:
Rating: A

EXAMPLE 11

An aluminum sheet as described in Comparative Example 2, anodically oxidized in phosphoric acid, is processed as described in Example 1, except that the after-treatment is carried out by immersion in a 1% strength solution of the silane hydrolysis product at 25° C.
Test result:
Rating: A

EXAMPLE 12

A printing plate produced as described in Example 10 is first stored for 30 days at 50° C. and then processed in a conventional manner.
Test result:
Rating: A

We claim:

1. An electrophotographic recording element for electrophotographic offset printing plates which comprises:

an anodically oxidized and mechanically, chemically and/or electrochemically pretreated aluminum base;

a photoconductive layer on the aluminum base, and a thin layer formed of a hydrolyzed or hydrolzyed and condensed silane compound or compounds and having hydrophilic properties between the aluminum base and the photoconductive layer, wherein the silane compound has the formula (1)

$$X\text{-}(CH_2)_y\text{-}Si(R^1)_n(OR_2)_{3-n} \quad (1)$$

where $R^1$ and $R^2$ are identical or different and are each alkyl of 1 to 9 carbon atoms or aryl of 6 to 12 carbon atoms, X is one of the radicals

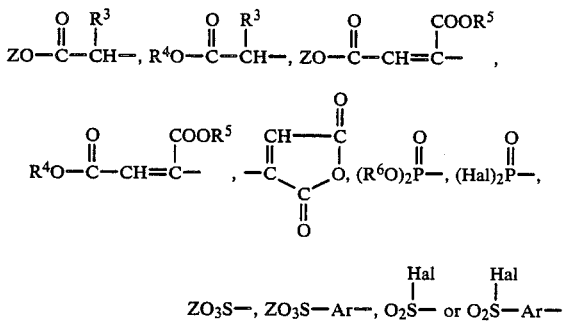

$R^3$ is hydrogen, alkyl of 1 to 9 carbon atoms, a carboxylic acid radical of 1 to 9 carbon atoms or a carboxylic anhydride ring formed from this carboxylic acid radical and the

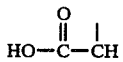

radical bonded to $R^3$, and $R^4$ and $R^5$ are identical or different and are each alkyl of 1 to 9 carbon atoms or aryl of 6 to 12 carbon atoms, $R^6$ is hydrogen, alkyl of 1 to 9 carbon atoms or aryl of 6 to 12 carbon atoms, Ar is arylene of 6 to 12 carbon atoms, Hal is chlorine or bromine, Z is hydrogen or an alkali metal, y is an integer from 1 to 4 and n is 0, 1 or 2.

* * * * *